US005277027A

United States Patent [19]

Aoyagi et al.

[11] Patent Number: 5,277,027

[45] Date of Patent: Jan. 11, 1994

[54] HYDRAULIC DRIVE SYSTEM WITH PRESSURE COMPENSTING VALVE

[75] Inventors: Yukio Aoyagi, Ibaraki; Tomohiko Yasuda, Kashiwa, both of Japan

[73] Assignee: Hitachi Construction Machinery Co., Ltd., Tokyo, Japan

[21] Appl. No.: 946,353

[22] PCT Filed: Apr. 15, 1992

[86] PCT No.: PCT/JP92/00477

§ 371 Date: Oct. 27, 1992

§ 102(e) Date: Oct. 27, 1992

[30] Foreign Application Priority Data

Apr. 15, 1991 [JP] Japan ..... 3-108105

[51] Int. Cl.[5] ..... F16D 31/02

[52] U.S. Cl. ..... 60/420; 60/452

[58] Field of Search ..... 60/420, 422, 427, 445, 60/452, 424

[56] References Cited

U.S. PATENT DOCUMENTS

| | | | |
|---|---|---|---|
| 3,720,059 | 3/1973 | Schurawski et al. | 60/427 X |
| 4,024,710 | 5/1977 | Zelle | 60/420 |
| 4,165,613 | 8/1979 | Bernhoft et al. | 60/420 |
| 4,334,408 | 6/1982 | La Pointe | 60/420 X |
| 4,349,319 | 9/1982 | Byers, Jr. et al. | 60/452 X |
| 5,083,428 | 1/1992 | Kubomoto et al. | 60/427 X |

FOREIGN PATENT DOCUMENTS

| | | |
|---|---|---|
| 61-24802 | 2/1986 | Japan . |
| 1-275902 | 11/1989 | Japan . |
| 3-74607 | 3/1991 | Japan . |

*Primary Examiner*—Edward K. Look
*Assistant Examiner*—John Ryznic
*Attorney, Agent, or Firm*—Fay, Sharpe, Beall, Fagan, Minnich & McKee

[57] ABSTRACT

A hydraulic drive system for construction machines comprising a valve group (52) including a plurality of directional control valves (9-13) of center bypass type, a center bypass line (2a) for connecting in series center bypasses of the plural directional control valves to a low-pressure circuit (29), a plurality of bleeding-off variable restrictor means (56) respectively disposed in the center bypasses of the plural directional control valves, a pressure compensating valve (20) provided in the center bypass line, and first and second differential pressure detecting lines (22, 24) connected to the center bypass line for transmitting a differential pressure to the pressure compensating valve. One (22) of the first and second differential pressure detecting lines (22,244) is connected to the center bypass line (2a) at a position between the bleeding-off variable restrictor means (56) of at least one particular directional control valve (9) in the valve group (52) and the bleeding-off variable restrictor means (56) of another directional control valve (10) adjacent to that particular directional control valve, and the other (24) of the first and second differential pressure detecting lines (22, 24) is connected to the center bypass line (2a) at a position adapted to detect a differential pressure across the bleeding-off variable restrictor means of at least that another directional control valve.

10 Claims, 13 Drawing Sheets

HYDRAULIC DRIVE SYSTEM WITH PRESSURE COMPENSTING VALVE

TECHNICAL FIELD

The present invention relates to a hydraulic drive system for construction machines such as hydraulic excavators, and more particularly to a hydraulic drive system for construction machines in which a pressure compensating valve provided in a center bypass line of a valve group gives a load compensating function to directional control valves included in the valve group.

BACKGROUND OF THE INVENTION

As disclosed in JP, A, 1-275902, there is conventionally known a hydraulic drive system for construction machines in which a pressure compensating valve provided in a center bypass line of a valve group gives a load compensating function to directional control valves included in the valve group. This prior hydraulic drive system comprises a hydraulic pump of variable displacement type, a plurality of hydraulic actuators driven by a hydraulic fluid supplied from the hydraulic pump, a valve group including a plurality of directional control valves of center bypass type for controlling respective flows of the hydraulic fluid supplied from the hydraulic pump to the plural hydraulic actuators, center bypass line for connecting in series center bypasses of the plural directional control valves to a reservoir, a plurality of bleeding-off variable restrictors respectively disposed in the center bypasses of the plural directional control valves to reduce their opening areas as input amounts of the corresponding directional control valves increase, a pressure compensating valve provided in the center bypass line at a position downstream of the valve group, first and second differential pressure detecting lines connected to the center bypass line for transmitting a differential pressure to the pressure compensating valve, a fixed restrictor provided in the center bypass line at a position downstream of the pressure compensating valve for producing a control pressure, and a pump regulator for changing the displacement volume of the hydraulic pump dependent upon the control pressure.

One of the first and second differential pressure detecting lines is connected to the center bypass line at a position upstream of the valve group, while the other line is connected to the center bypass line at a position downstream of the valve group.

In the hydraulic drive system thus arranged, the pump regulator for controlling the displacement volume of the hydraulic pump performs well-known negative control dependent upon the control pressure produced by the fixed restrictor. More specifically, as the amount of stroke of the directional control valve increases, the opening area of the bleeding-off variable restrictor is gradually reduced and fully closed at last. During this process, the flow rate of the hydraulic fluid passing through the center bypass line is reduced to make smaller the control pressure produced by the fixed restrictor and, correspondingly, the pump regulator is operated to gradually increase a delivery rate of the hydraulic pump. A metering characteristic of the hydraulic fluid supplied to the actuator is determined by both the pump flow rate characteristic and the characteristic of the bleeding-off variable restrictor in the above process.

Stated otherwise, when one of the plural directional control valves is operated, the delivery rate of the hydraulic pump is increased with the spool stroke increasing, as mentioned above. At the same time, as the spool stroke increases, the larger will be the opening areas of a meter-in variable restrictor and a meter-out variable restrictor of the directional control valve and the smaller will be the opening area of the bleeding-off variable restrictor. Therefore, the flow rate of the hydraulic fluid flowing from the hydraulic pump out to the reservoir through the center bypass line is reduced to make higher a delivery pressure of the hydraulic pump. Then, at the time the pressure at a pump port of the directional control valve becomes higher than the load pressure imposed on the actuator, the hydraulic fluid from the hydraulic pump begins to flow into the actuator side and, thereafter, the flow rate of the hydraulic fluid flowing from the pump out to the reservoir through the center bypass line is further reduced. Correspondingly, the flow rate of the hydraulic fluid flowing into the actuator side, i.e., the flow rate resulted by subtracting, from the pump flow rate, the flow rate of the hydraulic fluid flowing out to the reservoir through the center bypass line, is increased. This is generally called bleed-off control.

In addition, the pressure compensating valve provided in the center bypass line makes control so that a differential pressure across the bleeding-off variable restrictor of each directional control valve is held constant. Therefore, the flow rate of the hydraulic fluid flowing out to the reservoir through the bleeding-off variable restrictor is determined in magnitude by the opening area of the bleeding-off variable restrictor (i.e., the amount of stroke of the directional control valve) regardless of the magnitude of the pump delivery pressure, that is to say, the magnitude of the load pressure. Consequently, the flow rate of the hydraulic fluid flowing into the actuator side will not be affected by the load pressure, thus providing the so-called load compensating characteristic.

SUMMARY OF THE INVENTION

In the above-mentioned prior art, however, because the first and second differential pressure detecting lines for the pressure compensating valve are connected to the center bypass line at respective positions upstream and downstream of the valve group, all the directional control valves included in the valve group are given with a load compensating function. Accordingly, there has accompanied the problem that even for the actuator which requires adjustment of its drive pressure, the drive pressure cannot be adjusted, or operating efficiency of the work carried out by that actuator deteriorates.

For example, a hydraulic excavator equipped with the above-stated hydraulic drive system is sometimes used to perform the so-called swing/pressing/digging work in which side walls are dug while applying swing forces, or the work in which vertical walls are dug while applying pressing forces by an arm. In these types of work, when the movement of the actuator is restricted by engagement between a bucket and the surface being dug, the drive pressure is forced under action of the pressure compensating valve to reach at once the maximum pressure set by a relief valve. Consequently, it has been difficult to perform the work while holding the pressure at a value demanded by the operator.

An object of the present invention is to provide a hydraulic drive system for construction machines which can give a load compensating function to a directional control valve associated with an actuator that requires a load compensating characteristic, and can give a pressure control function to a directional control valve associated with an actuator that requires a pressure control characteristic.

To achieve the above object, according to the present invention, there is provided a hydraulic drive system for construction machines comprising a hydraulic pump, a plurality of hydraulic actuators driven by a hydraulic fluid supplied from said hydraulic pump, a valve group including a plurality of directional control valves of center bypass type for controlling respective flows of the hydraulic fluid supplied from said hydraulic pump to said plural hydraulic actuators, a low-pressure circuit, a center bypass line for connecting in series center bypasses of said plural directional control valves to said low-pressure circuit, a plurality of bleeding-off variable restrictor means respectively disposed in the center bypasses of said plural directional control valves to reduce their opening areas as input amounts of the corresponding directional control valves increase, a pressure compensating valve provided in said center bypass line, and first and second differential pressure detecting lines connected to said center bypass line for transmitting a differential pressure to said pressure compensating valve, wherein one of said first and second differential pressure detecting lines is connected to said center bypass line at a position between the bleeding-off variable restrictor means of at least one particular directional control valve in said valve group and the bleeding-off variable restrictor means of another directional control valve adjacent to said particular directional control valve, and the other of said first and second differential pressure detecting lines is connected to said center bypass line at a position adapted to detect a differential pressure across the bleeding-off variable restrictor means of at least said another directional control valve.

With the above arrangement, when at least the aforesaid another directional control valve is operated, the differential pressure across the bleeding-off variable restrictor means of the aforesaid another directional control valve is introduced to the pressure compensating valve through the first and second differential pressure detecting lines, and the aforesaid another directional control valve is given with a load compensating function by an action of the pressure compensating valve so that a load compensating characteristic may be given to the actuator controlled by the aforesaid another directional control valve. On the other hand, when the particular directional control valve is operated, the differential pressure produced upon shift operation of the particular directional control valve is not introduced to the pressure compensating valve and normal bleed-off control is performed regardless of the action of the pressure compensating valve. Accordingly, the particular directional control valve is given with a pressure control function so that a pressure control characteristic may be given to the actuator controlled by the particular directional control valve.

Any of the directional control valves can be set as the above particular directional control valve. In one embodiment, the particular directional control valve includes the directional control valve positioned in the most upstream side of the valve group. In this case, the pressure compensating valve is preferably connected to the center bypass line at a position downstream of the regulating valve group. With such an arrangement, nothing is interposed between a junction of one differential pressure detecting line led to the pressure compensating valve with the center bypass line and the pressure compensating valve, making it possible to achieve the shortest length of that one differential pressure detecting line. In addition, that one differential pressure detecting line can be provided in a spool of the pressure compensating valve if necessary, which results in the simplified structure.

In another embodiment, the particular directional control valve includes the directional control valve positioned in the most downstream side of the valve group. In this case, the pressure compensating valve is preferably connected to the center bypass line at a position upstream of the valve group. This arrangement also permits the simplified structure like the above embodiment.

The hydraulic drive system preferably further comprises a third differential pressure detecting line connected to the center bypass line, and first switch means for selectively connecting one of the first and second differential pressure detecting lines and the third differential pressure detecting line to the pressure compensating valve. In a state that the first differential pressure detecting line or the second differential pressure detecting line is connected to the pressure compensating valve, the particular directional control valve is given with a pressure control function as mentioned above. When the first switch means is operated to connect the third differential pressure detecting line to the pressure compensating valve, the differential pressure across the bleeding-off variable restrictor means of the particular directional control valve is introduced to the pressure compensating valve through the first and third differential pressure detecting lines, and the particular directional control valve is given with a load compensating function by the action of the pressure compensating valve. In other words, the particular directional control valve can be optionally given with either a pressure control function or a load compensating function by operating the first switch means.

In addition, the hydraulic drive system preferably further comprises second switch means for holding the pressure compensating valve at its fully opened position to selectively disable operation of the pressure compensating valve. When the second switch means is not operated, only the particular directional control valve is given with a pressure control function as stated before. When the second switch means is operated, the pressure compensating valve is disabled in its operation not to exhibit a load compensating characteristic so that all the directional control valves are operated under the normal bleed-off control and given with a pressure control function.

The second switch means is preferably means for selectively connecting drive sectors of the pressure compensating valve acting in the valve-closing direction to corresponding one of the first and second differential pressure detecting lines and the low-pressure circuit.

The hydraulic pump may be one of fixed displacement type, but is preferably one of variable displacement type. In the latter case, the hydraulic drive system preferably further comprises flow resistive means disposed in the center bypass line for producing a control pressure, and a pump regulator for changing the displacement volume of the hydraulic pump dependent upon the control pressure. The flow resistive means preferably includes a fixed restrictor.

Where the hydraulic pump is of the variable displacement type, the pump regulator performs well-known negative control dependent upon the control pressure produced by the flow resistive means. More specifically, as the amount of stroke of the directional control valve increases, the opening area of the bleeding-off variable restrictor is gradually reduced and fully closed at last. During this process, the flow rate of the hydraulic fluid passing through the center bypass line is reduced to make smaller the control pressure produced by the fixed restrictor and, correspondingly, the pump regulator is operated to gradually increase a delivery rate of the hydraulic pump. A metering characteristic of the hydraulic fluid supplied to the actuator is determined by both the pump flow rate characteristic and the characteristic of the bleeding-off variable restrictor in the above process.

Whether the hydraulic pump is one of fixed displacement type or one of variable displacement type, the directional control valve can be given with a load compensating function or a pressure control function dependent upon the connected position of the first or second differential pressure detecting line, as mentioned above.

BEST MODE FOR CARRYING OUT THE INVENTION

Preferred embodiments of the present invention will be hereinafter described with reference to the drawings. In these embodiments, the present invention is applied to a hydraulic drive system for hydraulic excavators.

To begin with, a first embodiment of the present invention will be explained by referring to FIGS. 1 to 4.

Figure 1:
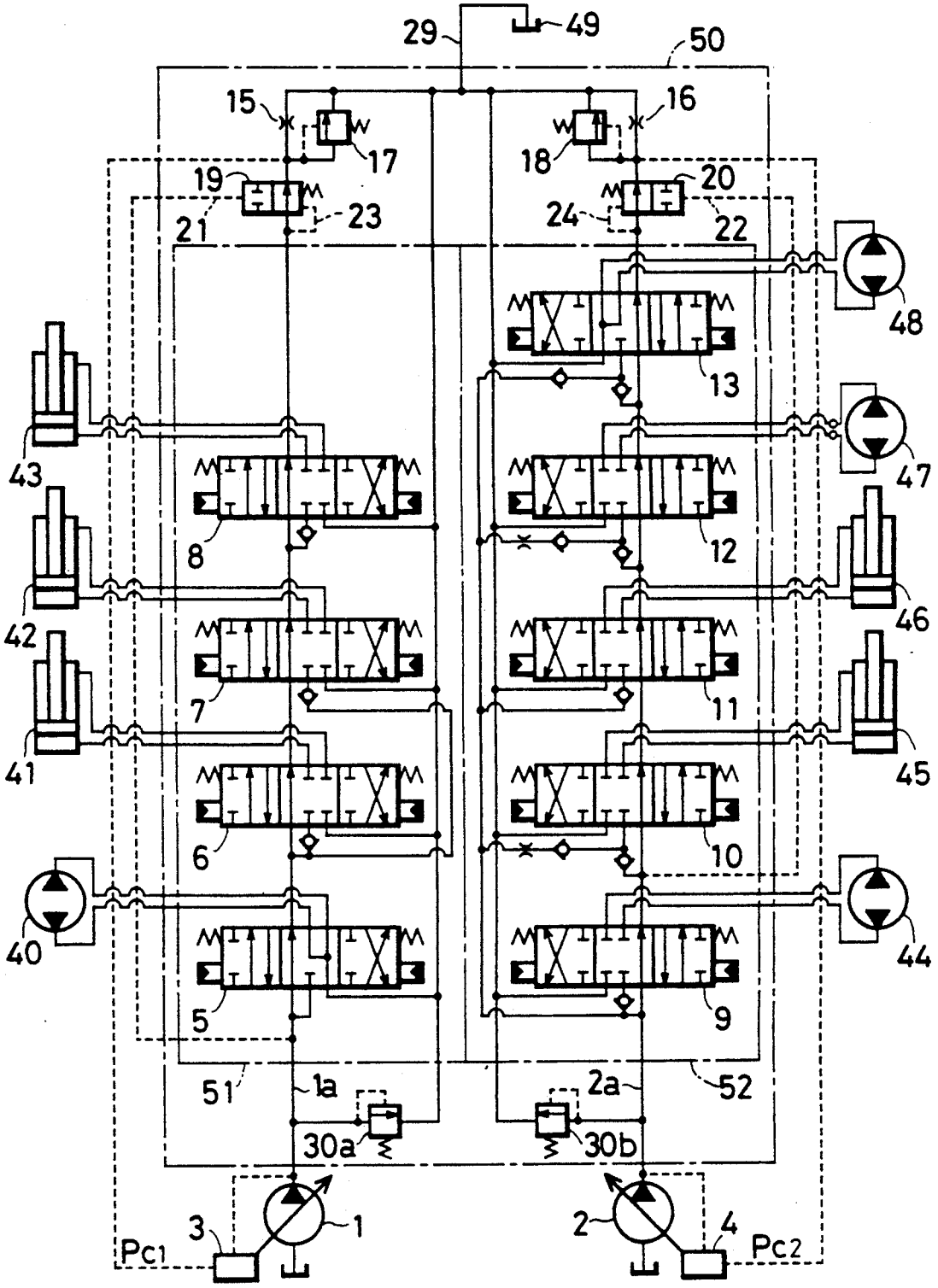
FIG. 1 is a circuit diagram of a hydraulic drive system for construction machines according to a first embodiment of the present invention.

In FIG. 1, the hydraulic drive system of this embodiment comprises hydraulic pumps 1, 2 of variable displacement type, pump regulators 3, 4 for controlling the respective displacement volumes of the hydraulic pumps 1, 2, a plurality of hydraulic actuators 40, 41, 42, 43, 44, 45, 46, 47, 48 driven by a hydraulic fluid supplied from the hydraulic pumps 1, a reservoir 49 constituting a low-pressure circuit, and a valve apparatus 50 installed between the hydraulic pumps 1, 2, the actuators 40 to 48 and the reservoir 49.

The valve apparatus 50 comprises a first valve group 51 which includes a plurality of directional control valves 5, 6, 7, 8 of center bypass type for controlling respective flows of the hydraulic fluid supplied from the hydraulic pump 1 to the plural hydraulic actuators 40 to 43, a second valve group 52 which includes a plurality of directional control valves 9, 10, 11, 12, 13 of center bypass type for controlling respective flows of the hydraulic fluid supplied from the hydraulic pump 2 to the plural hydraulic actuators 44 to 48, a center bypass line la connected to the hydraulic pump 1 and connecting in series center bypasses of the directional control valves 5 to 8 of the first valve group 51 to a reservoir 49, a center bypass line 2*a* connected to the hydraulic pump 2 and connecting in series center bypasses of the directional control valves 9 to 13 of the second valve group 52 to a low-pressure circuit 29, the low-pressure circuit 29 including the reservoir 49, a pressure compensating valve 19 provided in the center bypass line 1*a* at a position downstream of the first valve group 51, a pressure compensating valve 20 provided in the center bypass line 2*a* at a position downstream of the second valve group 52 adjacent to the most downstream directional control valve 13, a fixed restrictor 15 provided in the center bypass line 1*a* at a position downstream of the pressure compensating valve 19 for producing a control pressure Pcl, a relief valve 17 for making control so that the control pressure produced by the fixed restrictor 15 will not exceed a specified pressure, a fixed restrictor 16 provided in the center bypass line 2*a* at a position downstream of the pressure compensating valve 20 for producing a control pressure Pc2, a relief valve 18 for making control so that the control pressure produced by the fixed restrictor 16 will not exceed a specified pressure, and relief valves 30*a*, 30*b* respectively connected to the center bypass lines 1*a*, 2*a* at positions upstream of the first and second valve groups 51, 52 for making control so that delivery pressures of the hydraulic pumps 1, 2 will not exceed specified values. The pump regulators 3, 4 change the displacement volumes of the hydraulic pumps 1, 2 dependent upon the control pressures produced by the fixed restrictors 15, 16, respectively, thereby controlling a delivery rate of the hydraulic pump 1.

The hydraulic actuators 40, 41, 42, 43, 44, 45, 46, 48 are provided, by way of example, in the form of a right travel motor, a bucket cylinder, a boom cylinder, an arm cylinder (joined), a swing motor, an arm cylinder, a boom cylinder (joined), and a left travel motor, respectively. The hydraulic actuator 47 is in the form of a hydraulic motor as a removable attachment and, therefore, the associated directional control valve 12 is a spare for that attachment.

Figure 2:
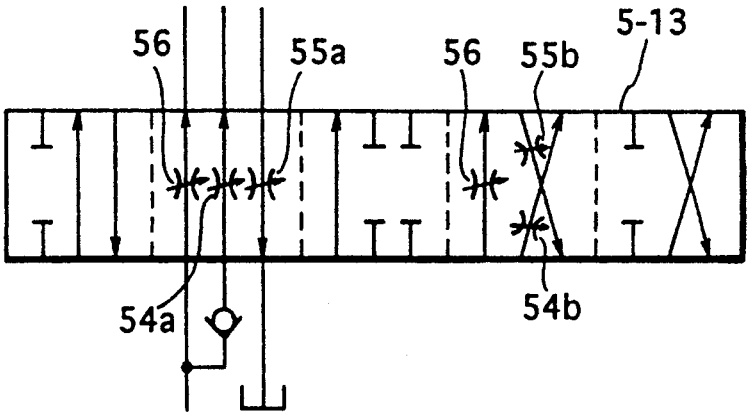
FIG. 2 is an explanatory view showing a transient position of each directional control valve shown in FIG. 1.
Figure 3:
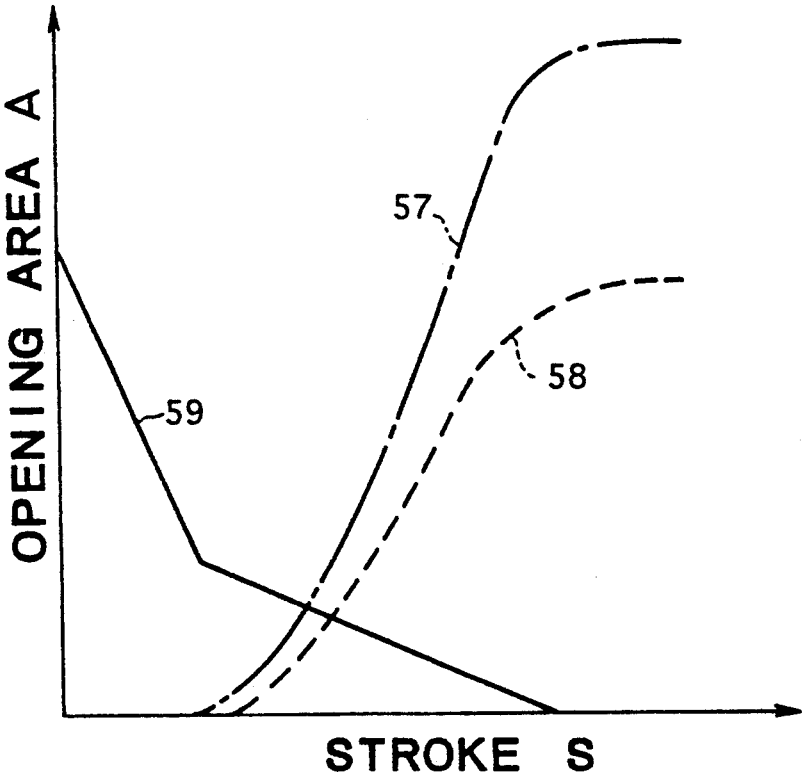
FIG. 3 is a graph showing opening characteristics of a bleeding-off variable restrictor, a meter-in variable restrictor and a meter-out variable restrictor with respect to an amount of stroke of the directional control valve shown in FIG. 1.
Figure 4:
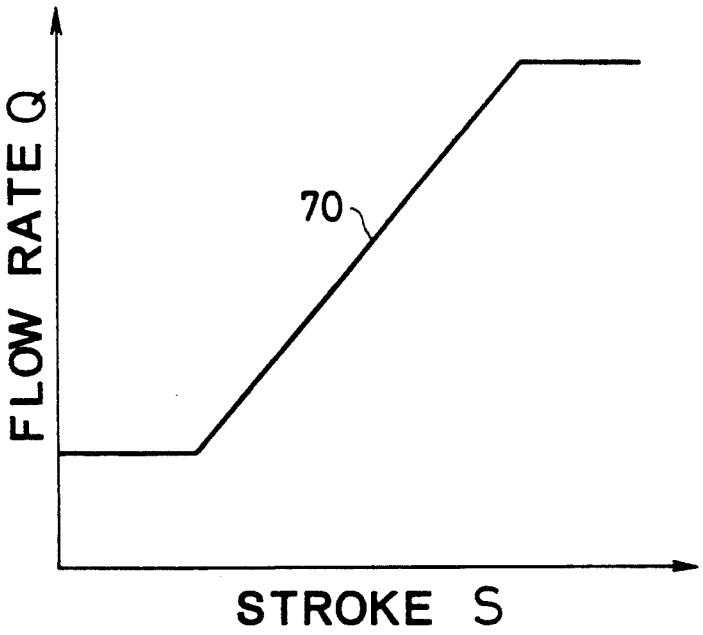
FIG. 4 is a graph showing the relationship of a pump delivery rate with respect to the amount of stroke of the directional control valve.

The directional control valves 5 to 13 are each, as shown in FIG. 2, formed with meter-in variable restrictors 54*a*, 54*b* (hereinafter represented by 54) and meter-out variable restrictors 55*a*, 55*b* (hereinafter represented by 55), and also provided in its center bypass with a variable restrictor 56 for bleeding-off. FIG. 3 shows the relationships between a spool stroke (input amount) S of the directional control valve and respective opening areas A of the meter-in variable restrictor 54, the meter-out variable restrictor 55 and the bleeding-off variable restrictor 56. More specifically, in the graph of FIG. 3, 57 and 58 indicate characteristics of the opening areas of the meter-in variable restrictor 54 and the meter-out variable restrictor 55, respectively, and 59 indicates a characteristic of the opening area of the bleeding-off variable restrictor 56. The meter-in variable restrictor 54 and the meter-out variable restrictor 55 are fully closed when the spool stroke is zero (i.e., when the directional control valve is at its neutral position), and their opening areas are increased as the spool stroke increases. On the other hand, the bleeding-off variable restrictor 56 is fully opened when the spool stroke is zero, and its opening area is reduced as the spool stroke increases.

By so setting the opening characteristic of the bleeding-off variable restrictor 56, when the directional control valve 5 is at its neutral position, for example, the flow rate of the hydraulic fluid flowing through the center bypass line 1*a* (i.e., the flow rate through the center bypass) is maximized and the control pressure Pcl produced by the fixed restrictor 15 is also maximized. As the input amount of the directional control valve 5 increases, the flow rate through the center bypass is reduced and so is the control pressure Pcl. In accordance with the control pressure Pcl, the pump regulator 3 makes control to minimize the displacement volume of the hydraulic pump 1 when the control pressure Pcl is at maximum, and increase the displacement volume of the hydraulic pump 1 with the control pressure Pcl becoming smaller. As a result, the delivery rate Q of the hydraulic pump 1 is controlled to increase dependent upon the amount of stroke S of the directional control valve 5, as shown at a characteristic line 70 in FIG. 4.

It will be noted that while the foregoing description is made relating to the directional control valve 5, it is equally applied to the other directional control valves 6 to 8 and also to the directional control valves 9 to 13 of the second valve group 52.

Figure 5:
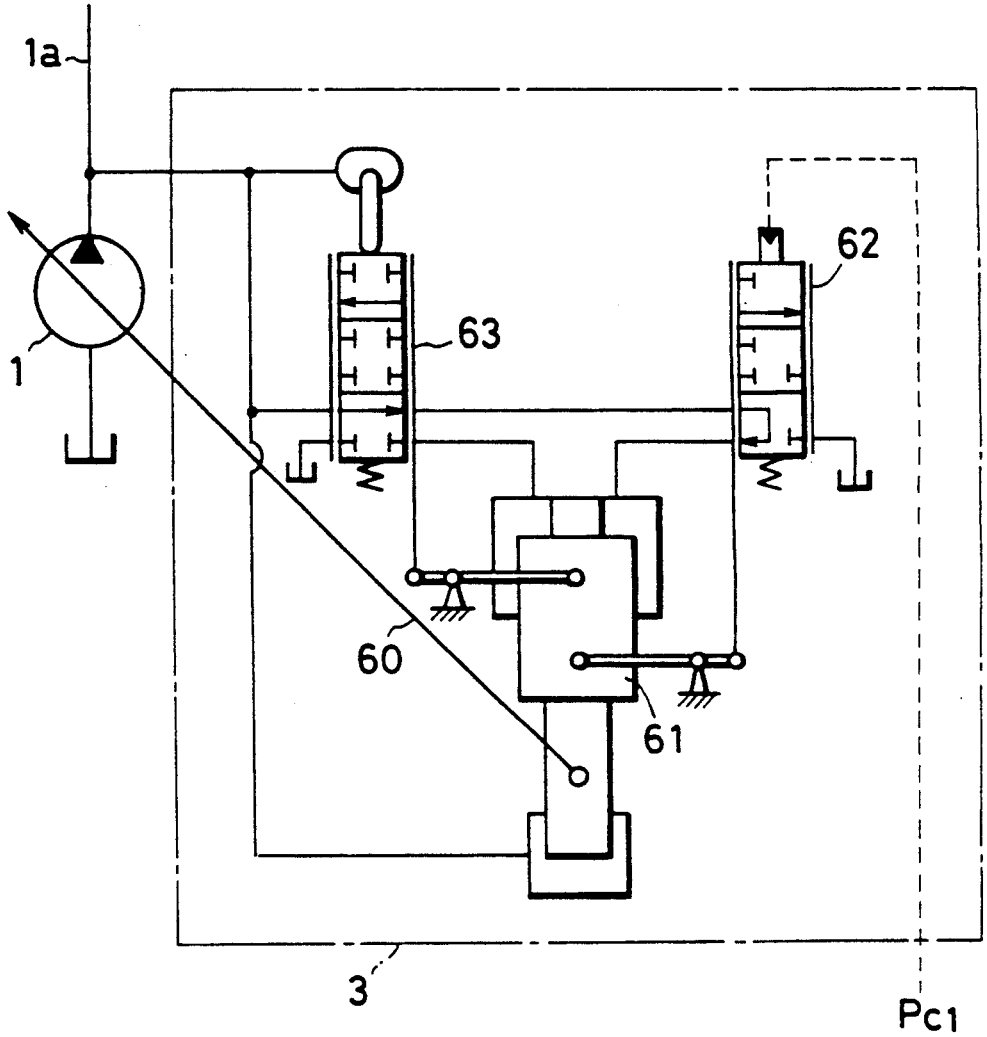
FIG. 5 is a circuit diagram showing details of a pump regulator shown in FIG. 1.

The pump regulator 3 comprises, as shown in FIG. 5, a piston/cylinder unit 61 for driving a displacement volume varying member, e.g., a swash plate 60, of the hydraulic pump 1, a first servo valve 62 responsive to the control pressure Pcl for adjusting the flow rate of the hydraulic fluid supplied to the piston/cylinder unit 61 and controlling a tilting amount of the swash plate of the hydraulic pump 1. With operation of the first servo valve 62, the tilting amount of the swash plate 60 is controlled so that the displacement volume of the hydraulic pump 1 is increased as the control pressure Pcl decreases from the maximum, as mentioned above. The pump regulator 3 also comprises a second servo valve 63 responsive to the pump delivery pressure for adjusting the flow rate of the hydraulic fluid supplied to the piston/cylinder unit 61 and controlling a tilting amount of the swash plate of the hydraulic pump 1 in order to limit an input torque. The pump regulator 4 is of the same construction.

The pressure compensating valve 19 is arranged to give a load compensating function to all the directional control valves 5 to 8 of the first valve group 51. More specifically, a first differential pressure detecting line 21 for introducing a hydraulic pressure to a drive sector, i.e., a pressure receiving chamber, of the pressure compensating valve 19 acting in the valve-closing direction is connected to the center bypass line 1*a* at a position upstream of the first valve group 51, whereas a second differential pressure detecting line 23 for introducing a hydraulic pressure to a drive sector, i.e., a pressure receiving chamber, of the pressure compensating valve 19 acting in the valve-opening direction is connected to the center bypass line 1*a* at a position downstream of the first valve group 51. With such an arrangement, when any of the directional control valves 5 to 8 is operated, the differential pressure across the associated variable restrictor 56 for bleeding-off, produced upon the valve operation, is introduced to the respective drive sectors of the pressure compensating valve 19 through the first and second differential pressure detecting lines 21, 23 so that the differential pressure across the variable restrictor 56 is controlled to be held constant.

Meanwhile, in the second regulating valve group 52, since the directional control valve 9 is to drive the swing motor 44, it is set as a particular valve which requires a pressure control function rather than a load compensating function. Therefore, the pressure compensating valve 20 is arranged to give a load compensating function to all the other directional control valves 10 to 13 of the second valve group 52. More specifically, a first differential pressure detecting line 22 for introducing a hydraulic pressure to a drive sector, i.e., a pressure receiving chamber, of the pressure compensating valve 20 acting in the valve-closing direction is connected to the center bypass line 2*a* at a position between the directional control valve 9 and the directional control valve 10 of the second valve group 52, whereas a second differential pressure detecting line 24 for introducing a hydraulic pressure to a drive sector, i.e., a pressure receiving chamber, of the pressure compensating valve 20 acting in the valve-opening direction is connected to the center bypass line 2*a* at a position downstream of the second valve group 52. With such an arrangement, when any of the directional control valves 10 to 13 is operated, the differential pressure across the associated bleeding-off variable restrictor 56, produced upon the valve operation, is introduced to the respective drive sectors of the pressure compensating valve 20 through the first and second differential pressure detecting lines 22, 24 so that the differential pressure across the variable restrictor 56 is controlled to be held constant.

In the above, even if the pressure compensating valves 19, 20 are respectively connected to the center bypass lines 1*a*, 2*a* at positions upstream of the first and second valve groups 51, 52, the similar load compensating function can be obtained. However, the pressure compensating valve 20 is preferably connected to the center bypass line 2a at a position downstream of the second valve group 52 for the reason as follows. With this arrangement, because the pressure compensating valve 20 is positioned adjacent to the directional control valve 13 which is to be given with a load compensating function, nothing is interposed between a junction of the second differential pressure detecting line 24 with the center bypass line 2a and the pressure compensating valve 20, making it possible to shorten the length of the second differential pressure detecting line 24. In addition, the second differential pressure detecting line 24 can be provided in a spool of the pressure compensating valve 20 if necessary, which results in the simplified structure of the valve apparatus 50.

In the hydraulic drive system arranged as previously explained, when one of the directional control valves 5 to 8, for example, the directional control valve 5, of the first regulating valve group 51 is operated, the delivery rate of the hydraulic pump is increased with the spool stroke S increasing, as mentioned before. At the same time, as the spool stroke S increases, the larger will be the opening areas A of the meter-in variable restrictor 54 and the meter-out variable restrictor 55 of the directional control valve 5 and the smaller will be the opening area A of the bleeding-off variable restrictor 56, whereby the delivery pressure of the hydraulic pump 1 is made higher. Then, at the time the pressure at a pump port of the directional control valve 5 becomes higher than the load pressure imposed on the actuator 40, the hydraulic fluid from the hydraulic pump 1 begins to flow into the actuator side and, thereafter, the flow rate of the hydraulic fluid flowing from the pump 1 out to the reservoir 49 through the center bypass line 1a is further reduced. Correspondingly, the flow rate of the hydraulic fluid flowing into the actuator 40 side, i.e., the flow rate resulted by subtracting, from the pump flow rate, the flow rate of the hydraulic fluid flowing out to the reservoir 49 through the center bypass line 1a, is increased. This is generally called bleed-off control.

Figure 6:
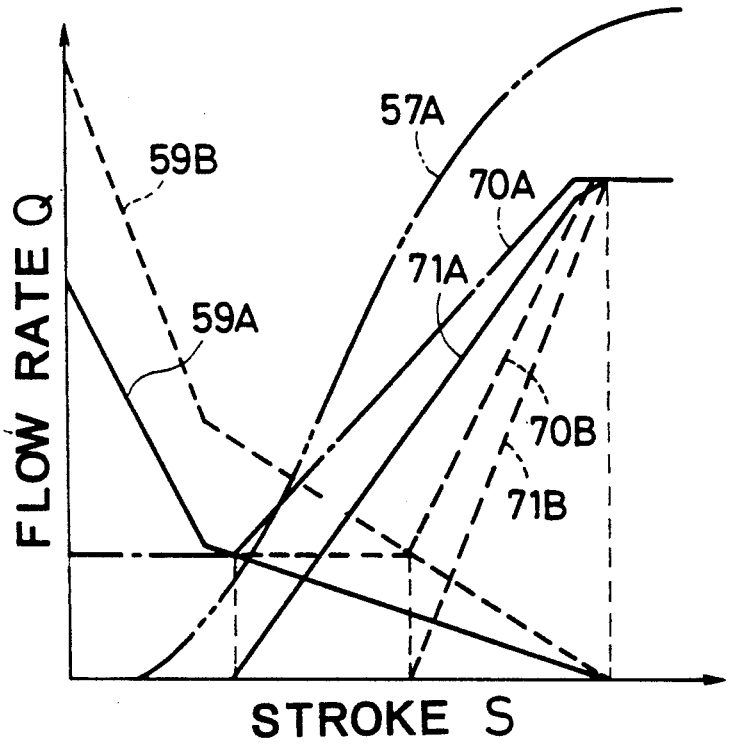
FIG. 6 is a graph showing control characteristics of the directional control valve shown in FIG. 1 with respect to the flow rate of a hydraulic fluid supplied to an actuator.

FIG. 6 shows control characteristics of the directional control valve during the bleed-off control. More specifically, assuming now that the load pressure of the actuator 40 is constant, the characteristic of the flow rate through the center bypass, that is allowed to flow out through the bleeding-off variable restrictor 56, with respect to the spool stroke S is given as shown at 59A in FIG. 6 corresponding to the opening characteristic 59 shown in FIG. 3. Since the delivery rate Q of the hydraulic pump 1 is given as shown at a characteristic line 70A in FIG. 6, the control characteristic of the directional control valve 5 with respect to the flow rate of the hydraulic fluid supplied to the actuator 40 is given as shown at 71A in FIG. 6. It will be noted that 57A indicates a characteristic, with respect to the spool stroke S, of the flow rate of the hydraulic fluid which can be supplied through the meter-in variable restrictor 54 of the directional control valve 5 having the characteristic 57 shown in FIG. 3, and the characteristic line 71A is set within the range defined by 57A. Thus, with the load pressure being constant in the bleed-off control, the control characteristic of the directional control valve with respect to the flow rate of the hydraulic fluid supplied to the actuator is determined by the opening characteristic of the bleeding-off variable restrictor and the flow rate characteristic of the hydraulic pump during normal operation in which the hydraulic fluid is supplied to the actuator for driving it.

Meanwhile, although the load pressure has been assumed to be constant in the above, it is in fact changed with the progress of the work or dependent upon situations of the work. In the actual case of the load pressure being changed, if the pressure compensating valve 19 is not provided for the first valve group 51, by way of example, the flow rate through the center bypass that is allowed to flow out via the bleeding-off variable restrictor 56 is also varied dependent upon such change in the load pressure. Specifically, when the load pressure of the actuator 40 becomes larger than that in the case represented by the characteristic 59A, the characteristic of the flow rate through the center bypass with respect to the spool stroke S is changed as shown at 59B in FIG. 6. In this case, corresponding to change in the amount of stroke S at which the hydraulic fluid begins to flow into the actuator 40 side, the characteristic of the delivery rate of the hydraulic pump 1 is also varied as shown at 70B in FIG. 6. Accordingly, the control characteristic of the directional control valve 5 with respect to the flow rate of the hydraulic fluid supplied to the actuator 40 is now given as shown at a characteristic line 71B in FIG. 6. In other words, the control characteristic of the directional control valve 5 with respect to the flow rate of the hydraulic fluid supplied to the actuator 40 is changed dependent upon fluctuations in the load pressure.

In this embodiment, on the contrary, since the pressure compensating valve 19 makes control so that the differential pressure across the bleeding-off variable restrictor 56 incorporated in each directional control valve is held constant, the flow rate of the hydraulic fluid flowing out to the reservoir through the bleeding-off variable restrictor 56 takes a value that is determined by the opening area of the bleeding-off variable restrictor 56 (i.e., the amount of stroke of the directional control valve) regardless of the magnitude of the pump delivery pressure, that is to say, the magnitude of the load pressure. Accordingly, the flow rate of the hydraulic fluid flowing into the actuator side is not affected by the load pressure and thus always controlled as shown at the characteristic line 71A in FIG. 6. In this way, for the first valve group 51, all the directional control valves are given with a load compensating function and the flow rate of the hydraulic fluid flowing into the actuator side is not affected by the load pressure, thereby providing a load compensating characteristic.

As with the above case, when any one of the directional control valves 10 to 13 is operated in the second valve group 52, all the directional control valves 10 to 13 are also given with a load compensating function and the flow rate of the hydraulic fluid flowing into the actuator side is not affected by the load pressure, thereby providing a load compensating characteristic.

Figure 7:
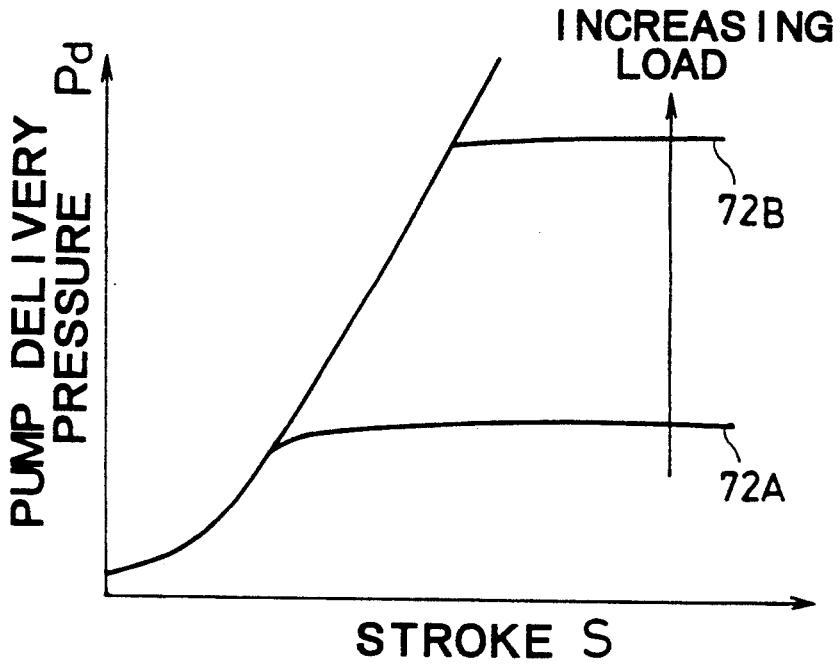
FIG. 7 is a graph showing the relationship of a delivery pressure of the hydraulic pump with respect to the amount of stroke of the directional control valve shown in FIG. 1.

On the other hand, when the directional control valve 9 associated with the swing motor 44 is operated, the differential pressure produced across the bleeding-off variable restrictor 56 incorporated in the directional control valve 9 is not introduced to the pressure compensating valve 20 and thus the normal bleed-off control is performed. In the normal bleed-off control, the delivery pressure Pd of the hydraulic pump is dependent upon the opening area of the bleeding-off variable restrictor. At some load pressure, therefore, the delivery pressure Pd of the hydraulic pump is changed or increased dependent upon the stroke amount until reaching that load pressure as indicated by a characteristic line 72A, for example, as shown in FIG. 7. At another larger load pressure, the characteristic line is given as indicated by 72B such that the pump delivery pressure Pd is changed or increased dependent upon the stroke amount until reaching a corresponding higher value. In other words, at any load pressure, the pump delivery pressure can be adjusted dependent upon the spool stroke S.

Thus, in the bleed-off control of the directional control valve 9, the above-stated load compensating function is not obtained, but the pump delivery pressure can be adjusted dependent on the amount of spool stroke S (i.e., the opening area of the bleeding-off variable restrictor 56). This makes it possible to desirably control the drive pressure of the swing motor 44 and to perform the swing/pressing/digging work or the like while adjusting the pressing forces at a desired value. Further, by regulating the drive pressure in acceleration during swing, the accelerated swing operation can also be performed in a smooth manner.

With the first embodiment, as explained above, the directional control valves 5 to 8 and 10 to 13 associated with the actuators 40 to 43 and 45 to 48 which require a load compensating characteristic can be given with a load compensating function, whereas the directional control valve 9 (the particular directional control valve) associated with the actuator which require pressure control, i.e., with the swing motor 44, can be given with a pressure control function. As a result, it is possible to obtain the superior working efficiency.

Additionally, in this embodiment, since the pressure compensating valve 20 is connected to the center bypass line 2*a* at a position downstream of the second regulating valve group 52 for providing the above-stated load compensating function by the pressure compensating valve 20, the length of the second differential pressure detecting line 24 can be shortened. Moreover, the second differential pressure detecting line 24 can be provided in the spool of the pressure compensating valve 20 if necessary, which results in the simplified structure of the valve apparatus 50.

It should be understood that while only the directional control valve 9 is set in the above first embodiment as the particular directional control valve which is to be given with a pressure control function, the present invention is not limited thereto and the particular directional control valve may be set plural in number. In this case, by disposing all those particular directional control valves in the most upstream side of the valve group and arranging the pressure compensating valve 20 in the downstream side, the above advantage of simplifying the valve structure can be obtained similarly.

A second embodiment of the present invention will be described below with reference to FIG. 8. In the drawing, identical members to those shown in FIG. 1 are denoted by the same reference numerals.

Figure 8:
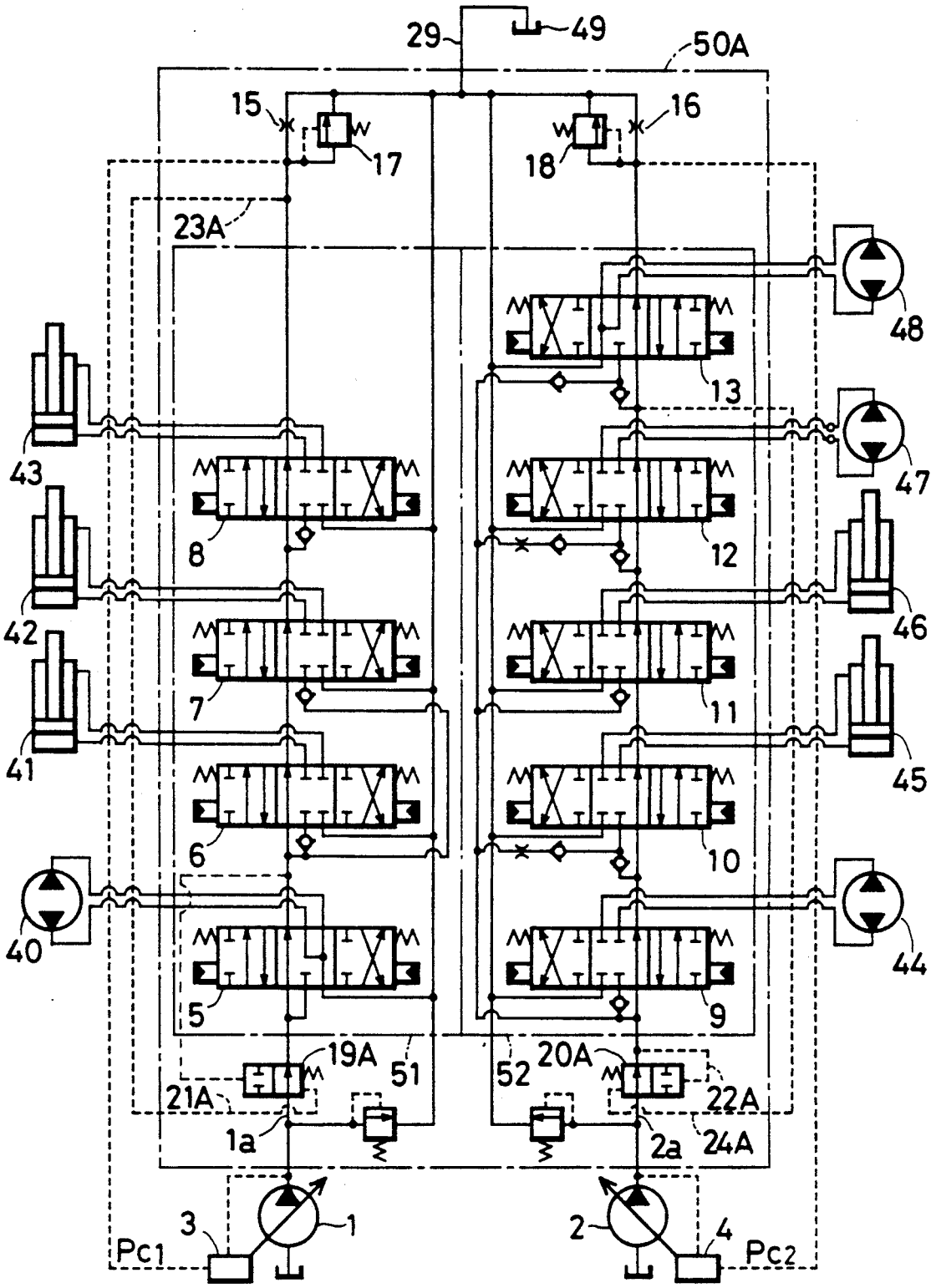
FIG. 8 is a circuit diagram of a hydraulic drive system for construction machines according to a second embodiment of the present invention.

In a valve apparatus 50A of this embodiment shown in FIG. 8, pressure compensating valves 19A, 20A are connected to the center bypass lines 1*a*, 2*a* at positions upstream of the first and second valve groups 51, 52, respectively. Furthermore, in order to provide a pressure control characteristic to both the hydraulic motors 40, 48 for traveling, the most upstream directional control valve 5 in the first valve group 51 is set as the particular directional control valve which is to be given with a pressure control function, and the most downstream directional control valve 13 in the second valve group 52 is set as the particular directional control valve which is to be given with a pressure control function.

More specifically, a first differential pressure detecting line 21A for introducing a hydraulic pressure to a drive sector of the pressure compensating valve 19A acting in the valve-closing direction is connected to the center bypass line la at a position between the directional control valve 5 and the directional control valve 6 of the first valve group 51, whereas a second differential pressure detecting line 23A for introducing a hydraulic pressure to a drive sector of the pressure compensating valve 19A acting in the valve-opening direction is connected to the center bypass line 1*a* at a position downstream of the first valve group 51. With such an arrangement, all the directional control valves 6 to 8 are given with a load compensating function and the directional control valve 5 is given with a pressure control function.

On the other hand, a first differential pressure detecting line 22A for introducing a hydraulic pressure to a drive sector of the pressure compensating valve 20A acting in the valve-closing direction is connected to the center bypass line 2*a* at a position upstream of the second valve group 52, whereas a second differential pressure detecting line 24A for introducing a hydraulic pressure to a drive sector of the pressure compensating valve 20A acting in the valve-opening direction is connected to the center bypass line 2*a* at a position between the directional control valve 12 and the directional control valve 13 of the second valve group 52. With such an arrangement, all the directional control valves 9 to 12 are given with a load compensating function and the directional control valve 13 is given with a pressure control function.

With the load compensating function and the pressure compensating function being provided separately from each other, this embodiment can also achieve the superior working efficiency similarly to the first embodiment.

Additionally, in this embodiment where the directional control valve 13 which is not to be given with a load compensating function is disposed in the most downstream side, the pressure compensating valve 20A is connected to the center bypass line 2*a* at a position upstream of the second valve group 52 so that it may be positioned adjacent to the directional control valve 9 which is to be given with a load compensating function. Therefore, nothing is interposed between a junction of the first differential pressure detecting line 22A with the center bypass line 2*a* and the pressure compensating valve 20A, making it possible to shorten the length of the second differential pressure detecting line 24A. In addition, the second differential pressure detecting line 24A can be provided in a spool of the pressure compensating valve 20A if necessary, which results in the simplified structure of the valve apparatus 50A.

It should be likewise understood that while only the directional control valve 13 is set in the above second embodiment as the particular directional control valve which is to be given with a pressure control function in the second valve group 52, the particular directional control valve may be set plural in number and all those particular directional control valves may be disposed in the most upstream side of the second valve group. In this case, too, the valve apparatus 50A can be simplified in its structure similarly to the above first embodiment.

A third embodiment of the present invention will be described below with reference to FIG. 9. In the drawing, identical members to those shown in FIG. 1 are denoted by the same reference numerals. This embodiment is obtained by modifying the embodiment of FIG. 1 such that the two pressure compensating valves 19, 20 are connected to the center bypass lines 1a, 2a at positions upstream of the first and second valve groups 51, 52, respectively, and two directional control valves of the second regulating valve group 52 spaced from each other are set as ones which are to be given with a pressure compensating function.

Figure 9:
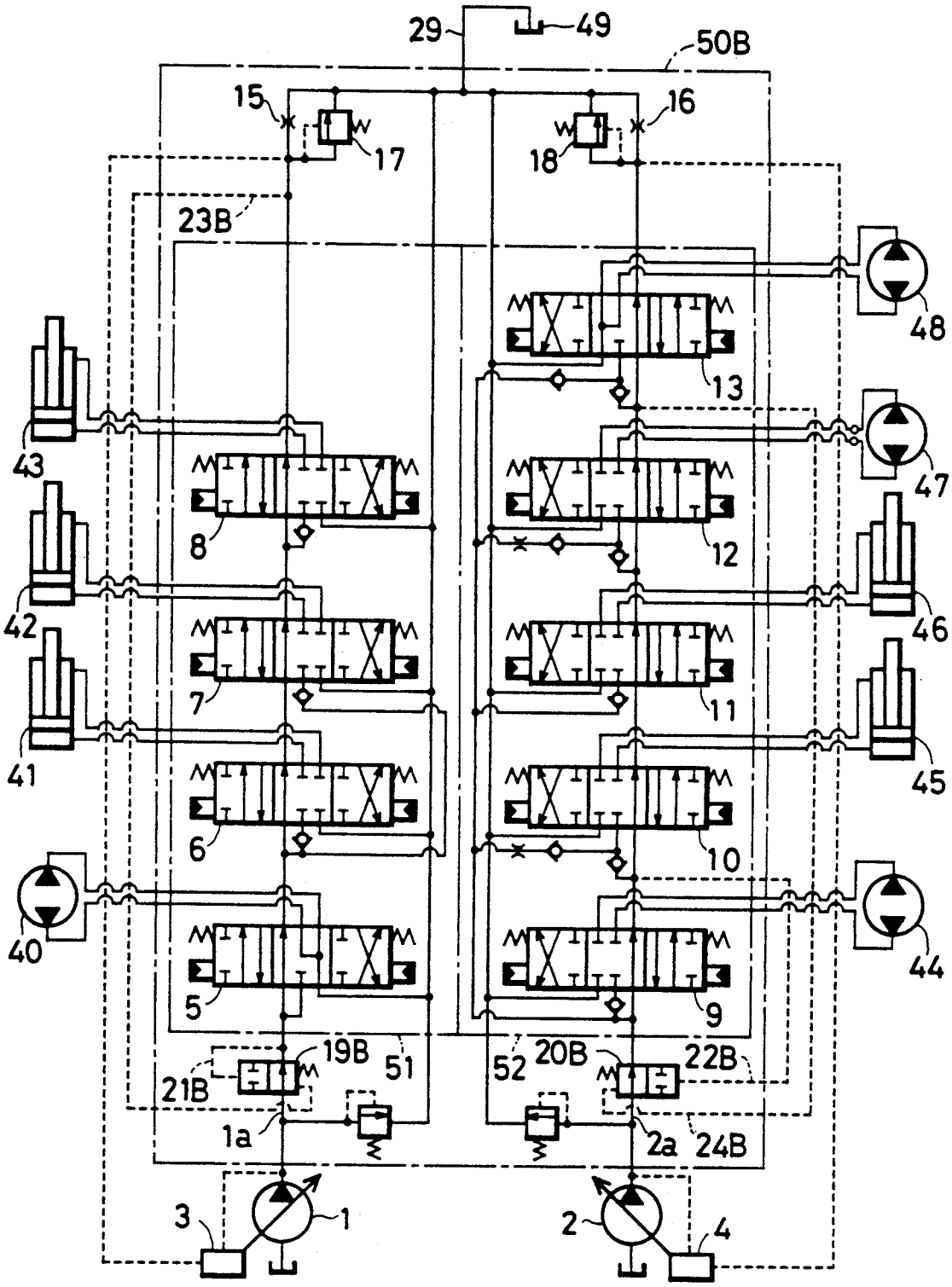
FIG. 9 is a circuit diagram of a hydraulic drive system for construction machines according to a third embodiment of the present invention.

More specifically, in FIG. 9, a valve apparatus 50B comprises pressure compensating valves 19B, 20B which are connected to the center bypass lines 1a, 2a at positions upstream of the first and second valve groups 51, 52, respectively. Furthermore, a first differential pressure detecting line 21B for introducing a hydraulic pressure to a drive sector of the pressure compensating valve 19B acting in the valve-closing direction is connected to the center bypass line 1a at a position upstream of the first valve group 51, whereas a second differential pressure detecting line 23B for introducing a hydraulic pressure to a drive sector of the pressure compensating valve 19B acting in the valve-opening direction is connected to the center bypass line la at a position downstream of the first valve group 51. With such an arrangement, all the directional control valves 5 to 8 are given with a load compensating function.

On the other hand, a first differential pressure detecting line 22B for introducing a hydraulic pressure to a drive sector of the pressure compensating valve 20B acting in the valve-closing direction is connected to the center bypass line 2a at a position between the directional control valve 9 and the directional control valve 10 of the second valve group 52, whereas a second differential pressure detecting line 24B for introducing a hydraulic pressure to a drive sector of the pressure compensating valve 20B acting in the valve-opening direction is connected to the center bypass line 2a at a position between the directional control valve 12 and the directional control valve 13 of the second valve group 52. With such an arrangement, all the directional control valves 10 to 12 are given with a load compensating function and the directional control valves 9, 13 are given with a pressure control function.

With the load compensating function and the pressure compensating function being provided separately from each other, this embodiment can also achieve the superior working efficiency similarly to the first embodiment.

A fourth embodiment of the present invention will be described below with reference to FIG. 10. In the drawing, identical members to those shown in FIG. 1 are denoted by the same reference numerals. This embodiment is designed to selectively give either a load compensating function or a pressure compensating function to the directional control valve.

Figure 10:
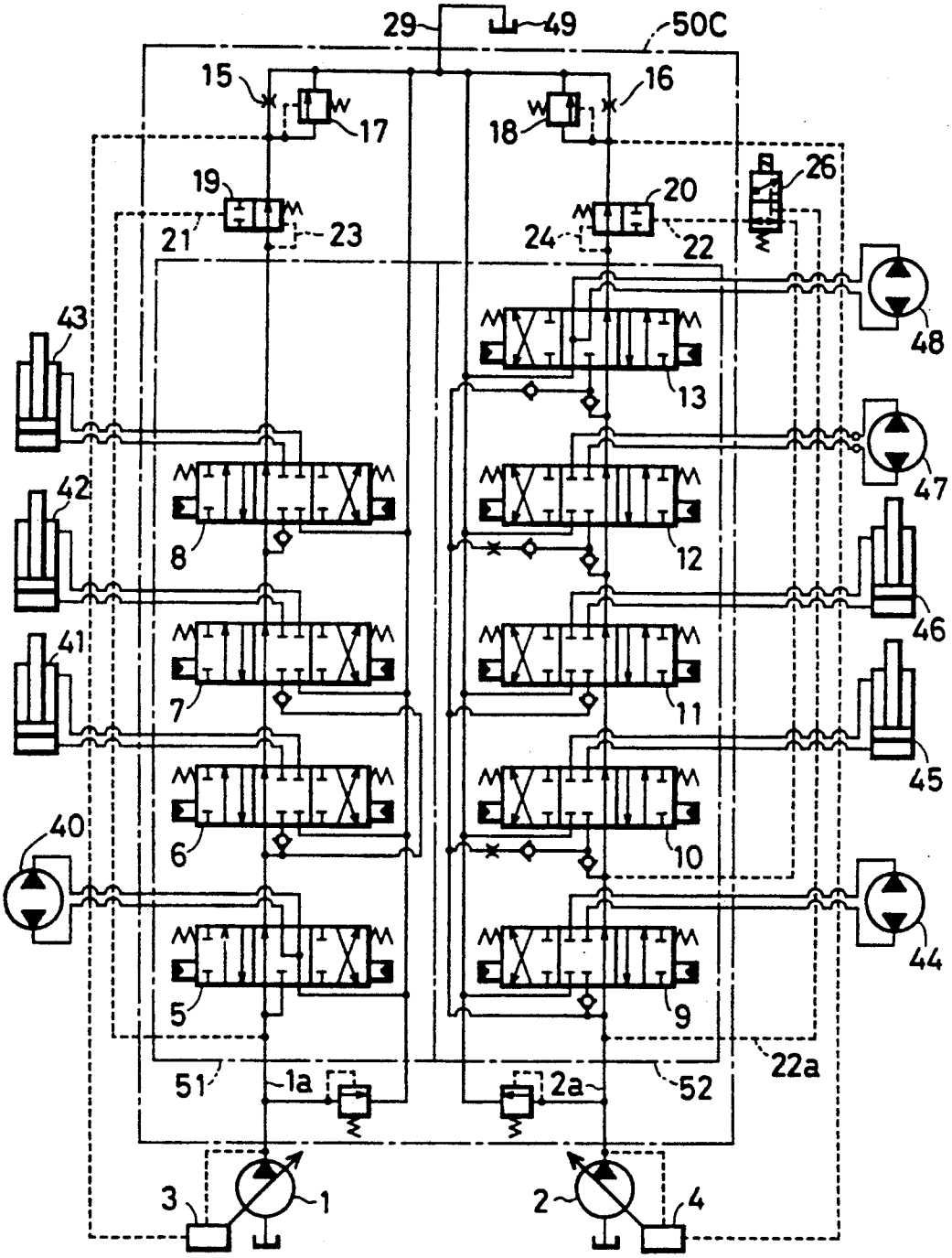
FIG. 10 is a circuit diagram of a hydraulic drive system for construction machines according to a fourth embodiment of the present invention.

In FIG. 10, a valve apparatus 50C is the same as that of the first embodiment shown in FIG. 1 except an arrangement of part for introducing a hydraulic pressure to the drive sector of the pressure compensating valve 20 acting in the valve-closing direction provided for the second valve group 52. More specifically, the arrangement of part for introducing a hydraulic pressure to the drive sector of the pressure compensating valve 20 acting in the valve-closing direction in this embodiment comprises the first differential pressure detecting line 22 and a third differential pressure detecting line 22a both for introducing a hydraulic pressure to the drive sector of the pressure compensating valve 20 acting in the valve-closing direction, and a solenoid switch valve 26 for selectively connecting the first and third differential pressure detecting lines 22, 22a to the drive sector of the pressure compensating valve 20 acting in the valve-closing direction. The first differential pressure detecting line 22 is connected to the center bypass line 2a at a position between the directional control valve 9 and the directional control valve 10 of the second valve group 52, whereas the third differential pressure detecting line 22a is connected to the center bypass line 2a at a position upstream of the second valve group 52. Incidentally, the switch valve 26 may be of a manually operated valve.

With this fourth embodiment, when the switch valve 26 is held at a position shown in FIG. 10, the first differential pressure detecting line 22 is selected so that the directional control valve 9 serves as the particular directional control valve which is to be given with a pressure control function because the differential pressure across the bleeding-off variable restrictor of the directional control valve 9 is not introduced to the pressure compensating valve 20. When the switch valve 26 is shifted from the illustrated position, the third differential pressure detecting line 22a is selected so that the differential pressure across the bleeding-off variable restrictor of the directional control valve 9 is introduced to the drive sector of the pressure compensating valve 20 acting in the valve-closing direction. As a result, the directional control valve 9 is given with a load compensating function.

Thus, with this embodiment the directional control valve 9 can be optionally given with either a pressure control function or a load compensating function upon operation of the switch valve 26, making it possible to further improve the working efficiency.

A fifth embodiment of the present invention will be described below with reference to FIG. 11. In the drawing, identical members to those shown in FIG. 1 are denoted by the same reference numerals. This embodiment is designed to selectively disable operation of the pressure compensating valve.

Figure 11:
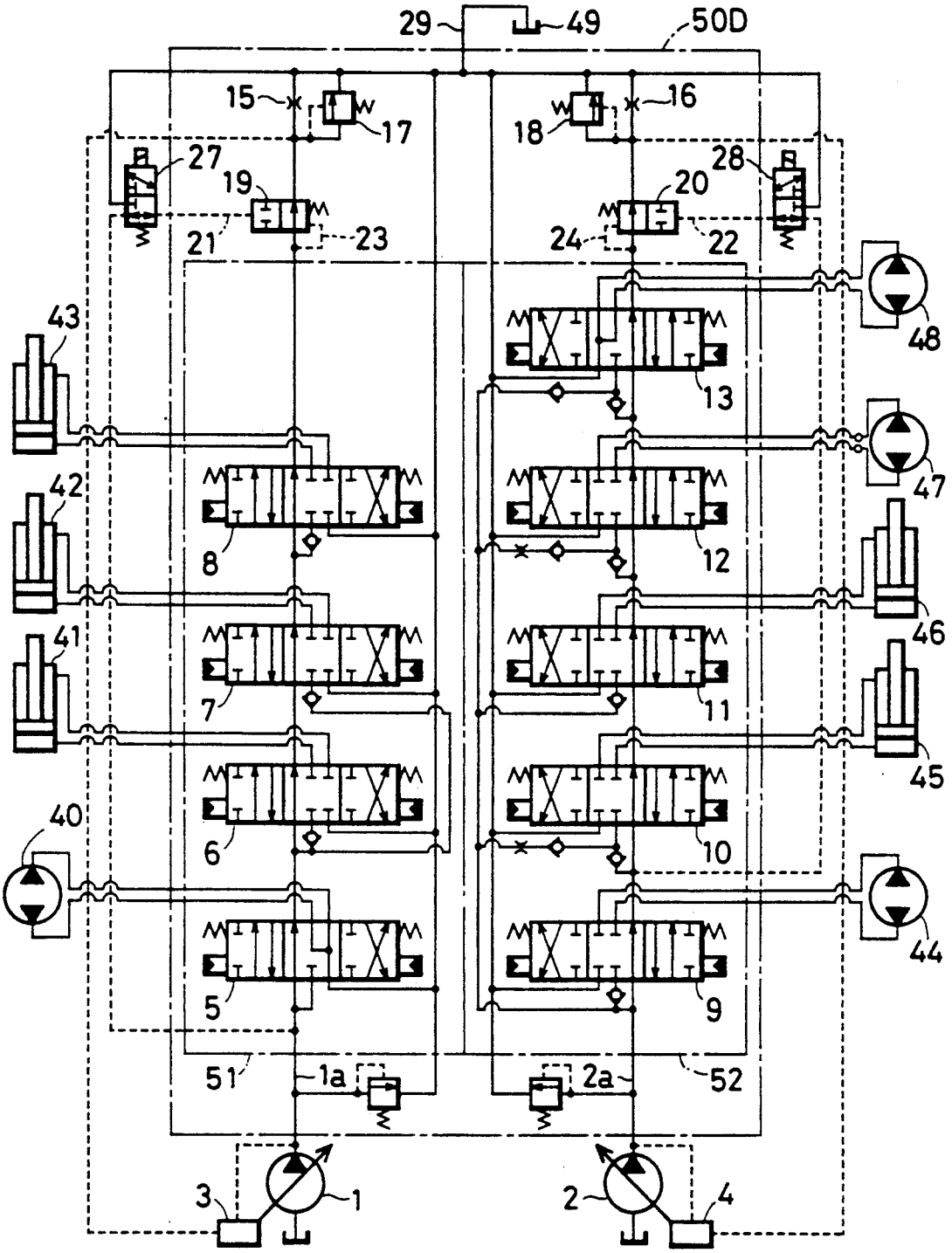
FIG. 11 is a circuit diagram of a hydraulic drive system for construction machines according to a fifth embodiment of the present invention.

In FIG. 11, a valve apparatus 50D is the same as that of the first embodiment shown in FIG. 1 except an arrangement of part for introducing a hydraulic pressure to the drive sectors of the pressure compensating valves 19, 20 acting in the valve-closing direction. More specifically, the arrangement of introducing a hydraulic pressure to the drive sectors of the pressure compensating valves 19, 20 acting in the valve-closing direction in this embodiment comprises the first differential pressure detecting lines 21, 22 for introducing a hydraulic pressure to the drive sectors of the pressure compensating valves 19, 20 acting in the valve-closing direction, and solenoid switch valves 27, 28 for selectively connecting the drive sectors of the pressure compensating valves 19, 20 acting in the valve-closing direction to one of the first differential pressure detecting lines 21, 22 and the low-pressure circuit 29, respectively. The first differential pressure detecting lines 21, 22 are connected to the center bypass lines 1a, 2a as with the first embodiment shown in FIG. 1, respectively. Incidentally, the switch valves 27, 28 may be of manually operated valves.

With this fifth embodiment, when the switch valves 27, 28 are held at positions shown in FIG. 11, the pressure compensating valves 19, 20 are enabled to operate in a normal manner and, therefore, the directional control valves 5 to 8 and the directional control valves 10 to 13 are all given with a load compensating function. On the contrary, when the switch valves 27, 28 are shifted from the illustrated position, the drive sectors of the pressure compensating valves 19, 20 acting in the valve-closing direction are connected to the low-pressure circuit 29 and, therefore, the pressure compensating valves 19, 20 are kept fully opened. As a result, the load compensating function is disabled and all the directional control valves 5 to 13 are given with a pressure control function through the bleed-off control.

It will be understood that while the load compensating function of the directional control valves is disabled in the above fifth embodiment by connecting the drive sectors of the pressure compensating valves 19, 20 acting in the valve-closing direction to the low-pressure circuit 29, the present invention is not limited thereto and, by way of example, those drive sectors acting in the valve-closing direction may be connected to those drive sectors acting in the valve-closing direction to provide the same pressure in both the drive parts so that the pressure compensating valves 19, 20 are held at their fully opened positions. This means that the fifth embodiment is practicable with any desired means so long as the pressure compensating valves 19, 20 are essentially disable in operation.

A sixth embodiment of the present invention will be described below with reference to FIGS. 12 to 14. In the drawing, identical members to those shown in FIG. 1 are denoted by the same reference numerals. In this embodiment, a pump of fixed displacement type is used as the hydraulic pump in place of the variable displacement type.

Figure 12:
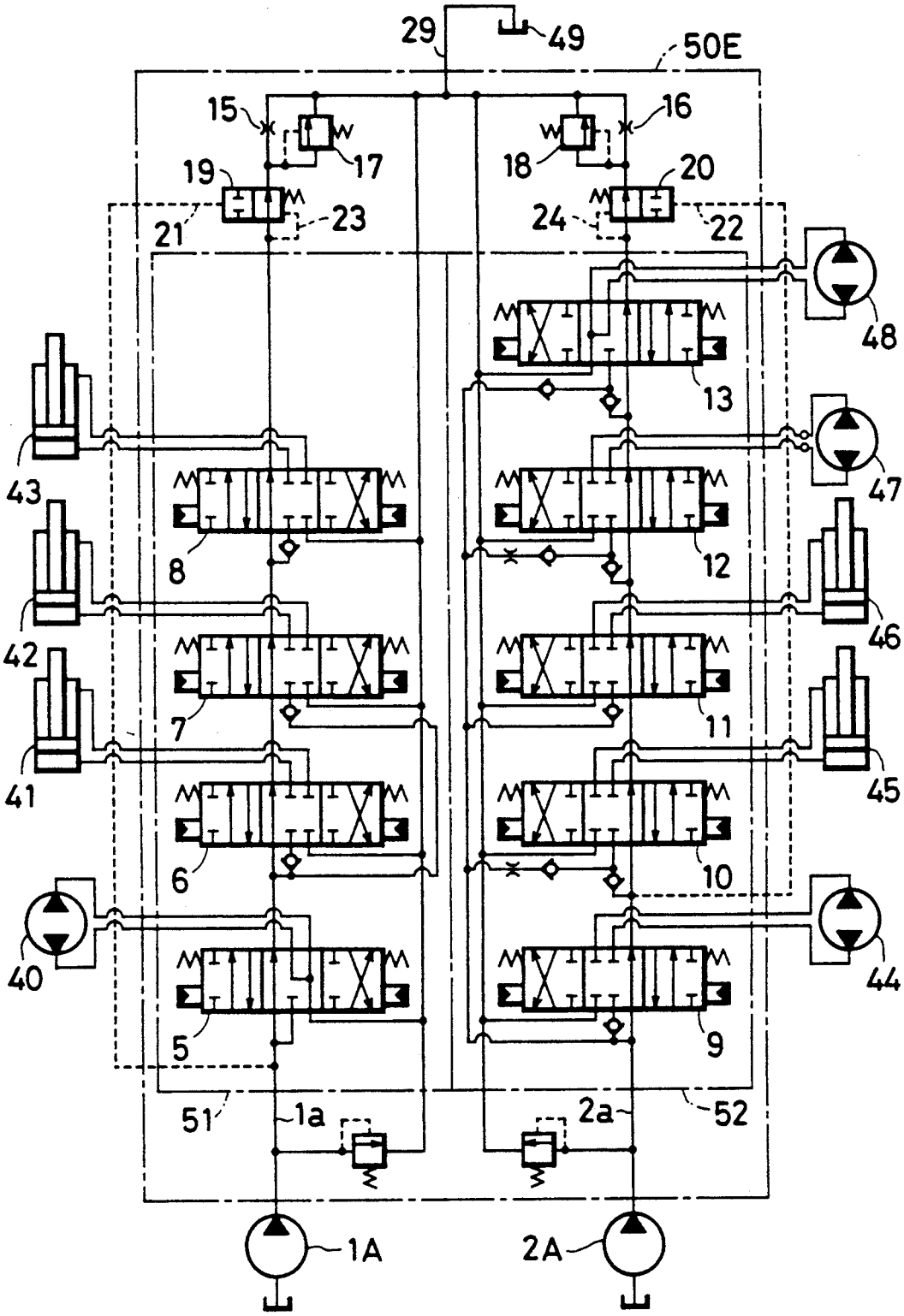
FIG. 12 is a circuit diagram of a hydraulic drive system for construction machines according to a sixth embodiment of the present invention.

More specifically, in FIG. 12, a hydraulic drive system of this embodiment has hydraulic pumps 1A, 2A of fixed displacement type, and a valve apparatus 50E for controlling flows and pressures of the hydraulic fluid from the hydraulic pumps 1A, 2A is of the same structure as that of the embodiment shown in FIG. 1.

Figure 13:
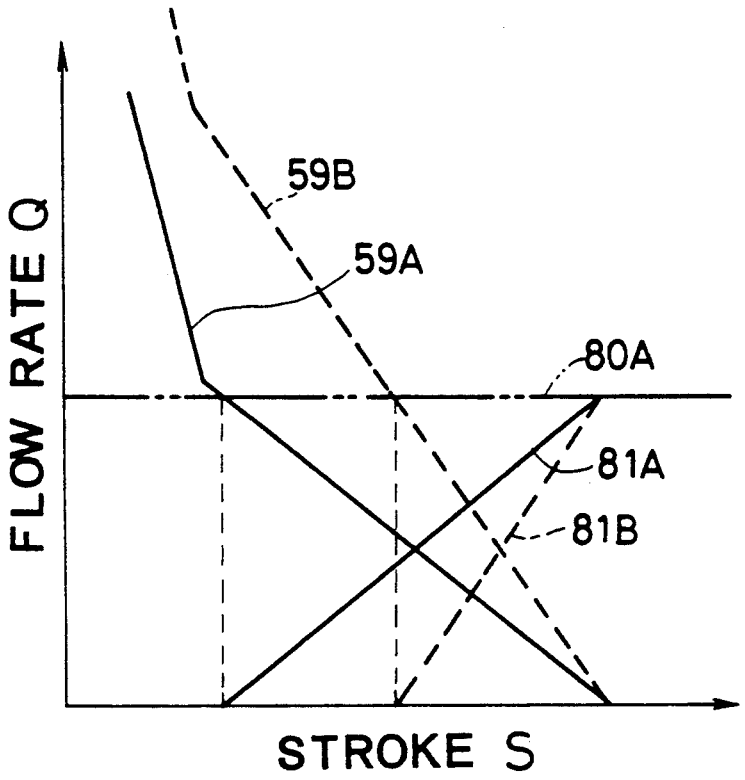
FIG. 13 is a graph showing control characteristics of each directional control valve shown in FIG. 12 with respect to the flow rate of a hydraulic fluid supplied to an actuator.
Figure 14:
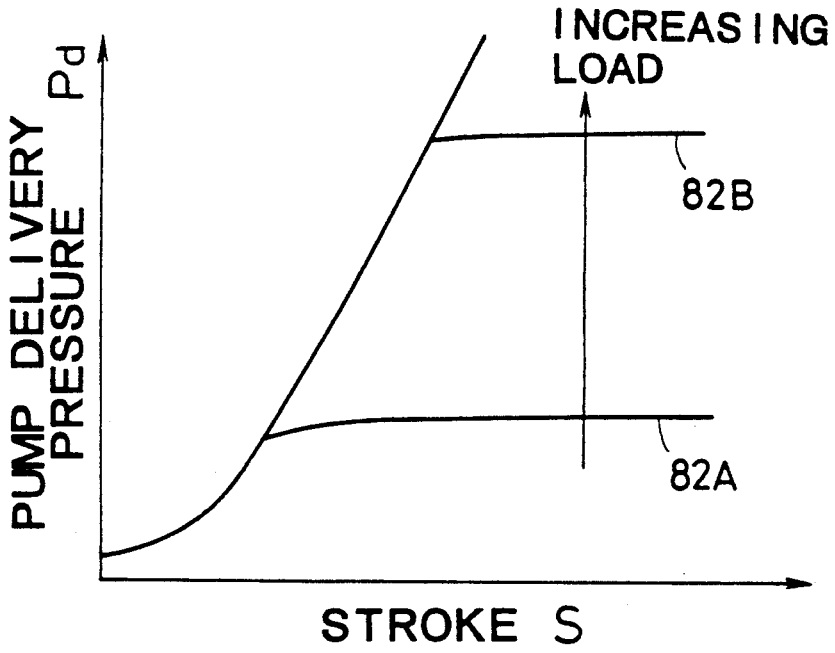
FIG. 14 is a graph showing the relationship of a delivery pressure of the hydraulic pump with respect to the amount of stroke of the directional control valve shown in FIG. 12.

FIG. 13 shows control characteristics of each of directional control valves during the bleed-off control in the case of using hydraulic pumps IA, 2A of variable displacement type. In the graph of FIG. 13, the same characteristics as those shown in FIG. 7 are indicated by the same reference numerals. Supposing that the directional control valve 5 is not given with a load compensating function, by way of example, when the actuator 40 is under some load pressure, the characteristic of the flow rate through the center bypass, that is allowed to flow out through the bleeding-off variable restrictor 56 (see FIG. 2) of the directional control valve 5, with respect to the spool stroke S is given as shown at 59A in FIG. 13 corresponding to the opening characteristic 59 shown in FIG. 3. With the load pressure of the actuator 40 increasing, the flow rate through the center bypass is also increased and the characteristic of the flow rate through the center bypass with respect to the spool stroke S is changed as shown at 59B in FIG. 13. On the other hand, the delivery rate Q of the hydraulic pump 1A is given as shown at 80A in FIG. 13. Accordingly, the control characteristic of the directional control valve 5 with respect to the flow rate of the hydraulic fluid supplied to the actuator 40 is given as shown at 81A in FIG. 13 before the increase in the load pressure, and then changed as shown at 81B with the load pressure increasing.

In this embodiment, on the contrary, since the pressure compensating valve 19 makes control so that the differential pressure across the bleeding-off variable restrictor 56 incorporated in each directional control valve is held constant, the flow rate of the hydraulic fluid flowing out to the reservoir through the bleeding-off variable restrictor 56 takes a value that is determined by the opening area of the bleeding-off variable restrictor 56 (i.e., the amount of stroke of the directional control valve) regardless of the magnitude of the pump delivery pressure, that is to say, the magnitude of the load pressure. Accordingly, the flow rate of the hydraulic fluid flowing into the actuator side is not affected by the load pressure and thus always controlled as shown at the characteristic line 81A in FIG. 13. As a result, like the first embodiment using the hydraulic pump of variable displacement type, the directional control valves 5 to 8 and 10 to 13 are all given with a load compensating function.

On the other hand, when the directional control valve 9 associated with the swing motor 44 is operated, the differential pressure produced across the bleeding-off variable restrictor 56 incorporated in the directional control valve 9 is not introduced to the pressure compensating valve 20 and thus the normal bleed-off control is performed. In the normal bleed-off control, the delivery pressure Pd of the hydraulic pump is dependent upon the flow rate of the hydraulic fluid flowing out through the bleeding-off variable restrictor. At some load pressure, therefore, the delivery pressure Pd of the hydraulic pump is changed or increased dependent upon the stroke amount until reaching that load pressure as indicated by a characteristic line 82A, for example, as shown in FIG. 14. At another larger load pressure, the characteristic line is given as indicated by 82B such that the pump delivery pressure Pd is changed or increased dependent upon the stroke amount until reaching a corresponding higher value. Thus, in the case of using the pumps of fixed displacement type, the pump delivery pressure can also be adjusted dependent upon the spool stroke S. Also with the sixth embodiment, therefore, the directional control valves 5 to 8 and 10 to 13 associated with the actuators 40 to 43 and 45 to 48 which require a load compensating characteristic can be given with a load compensating function, whereas the directional control valve 9 (the particular directional control valve) associated with the actuator which require pressure control, i.e., with the swing motor 44, can be given with a pressure control function. As a result, it is possible to obtain the superior working efficiency.

It will be understood that while the fixed restrictors 15, 16 are used in the above embodiments as flow resistive means for producing the control pressure, a relief valve having an override characteristic may be used in place of the fixed restrictor.

INDUSTRIAL APPLICABILITY

The hydraulic drive system for construction machines of the present invention arranged as explained above can provide the following advantages.

(1) Those directional control valves which require a load compensating characteristic can be given with a load compensating function, and those directional control valves which require a pressure control characteristic can be given with a pressure control function, thereby improving the working efficiency as compared with the prior art. In particular, this leads to the advantages cited below.

By properly considering in advance the position at which the differential pressure detecting line is connected to the center bypass line, each directional control valve can be optionally set as any of one which exhibits a pressure control function and one which exhibits a load compensating function.

The particular directional control valve which is given with a pressure control function permits the work to be performed while adjusting the pressing forces produce by the actuator at a desired value, by appropriately regulating the amount of spool stroke. Further, the actuator can be accelerated at start-up with desired smoothness by appropriately adjusting the amount of spool stroke.

(2) By properly selecting the installed position of the pressure compensating valve dependent upon the position of the particular directional control valve, nothing is interposed between a junction of one differential pressure detecting line led to the pressure compensating valve with the center bypass line and the pressure compensating valve, making it possible to achieve the shortest length of that one differential pressure detecting line. In addition, that one differential pressure detecting line can be provided in a spool of the pressure compensating valve if necessary, which results in the simplified structure.

(3) By selectively connecting an additional differential pressure detecting line and one of the first and second differential pressure detecting lines to the pressure compensating valve, the control function of the particular directional control valve can be optionally switched over to any of the pressure control function and the load compensating function even during the work.

(4) By holding the pressure compensating valve at its fully opened position to selectively disable operation thereof, the operation mode can be optionally switched over between a mode of giving a pressure control function to the particular directional control valve and a mode of operating all the directional control valves under the normal bleed-off control to exhibit a pressure control function.

What is claimed is:

1. A hydraulic drive system for a construction machine comprising a hydraulic pump (2), a plurality of hydraulic actuators (44–48) driven by a hydraulic fluid supplied from said hydraulic pump, a valve group (52) including a plurality of directional control valves (9–13) of center bypass type for controlling respective flows of the hydraulic fluid supplied from said hydraulic pump to said plural hydraulic actuators, a low-pressure circuit (29), a center bypass line (2a) for connecting in series center bypasses of said plural directional control valves to said low-pressure circuit, a plurality of bleeding-off variable restrictor means (56) respectively disposed in the center bypasses of said plural directional control valves to reduce their opening areas as input amounts of the corresponding directional control valves increase, a pressure compensating valve (20) provided in said center bypass line, and first and second differential pressure detecting lines (22, 24) connected to said center bypass line for transmitting a differential pressure to said pressure compensating valve, wherein:

one (22) of said first and second differential pressure detecting lines (22, 24) is connected to said center bypass line (2a) at a position between the bleeding-off variable restrictor means (56) of at least one particular directional control valve (9) in said valve group (52) and the bleeding-off variable restrictor means (56) of another directional control valve (10) adjacent to said particular directional control valve, and the other (24) of said first and second differential pressure detecting lines (22, 24) is connected to said center bypass line (2a) at a position adapted to detect a differential pressure across the bleeding-off variable restrictor means of at least said another directional control valve.

2. A hydraulic drive system for a construction machine according to claim 1, wherein said particular directional control valve includes the directional control valve (9) positioned in the most upstream side of said valve group (52).

3. A hydraulic drive system for a construction machine according to claim 2, wherein said pressure compensating valve (20) is connected to said center bypass line (2a) at a position downstream of said valve group (52).

4. A hydraulic drive system for a construction machine according to claim 1, wherein said particular directional control valve includes the directional control valve (13) positioned in the most downstream side of said valve group (52).

5. A hydraulic drive system for a construction machine according to claim 4, wherein said pressure compensating valve (20A) is connected to said center bypass line (2a) at a position upstream of said valve group (52).

6. A hydraulic drive system for a construction machine according to claim 1, further comprising a third differential pressure detecting line (22a) connected to said center bypass line (2a), and first switch means (26) for selectively connecting one (22) of said first and second differential pressure detecting lines (22, 24) and said third differential pressure detecting line (22a) to said pressure compensating valve (20).

7. A hydraulic drive system for a construction machine according to claim 1, further comprising second switch means (28) for holding said pressure compensating valve (20) at its fully opened position to selectively disable operation of said pressure compensating valve (20).

8. A hydraulic drive system for a construction machine according to claim 7, wherein said second switch means (28) is means for selectively connecting drive sectors of said pressure compensating valve (20) acting in the valve-closing direction to corresponding one (22) of said first and second differential pressure detecting lines (22, 24) and said low-pressure circuit (29).

9. A hydraulic drive system for a construction machine according to claim 1, wherein said hydraulic pump is a hydraulic pump (2) of variable displacement type, and said system further comprises flow resistive means (16) disposed in said center bypass line (2a) for producing a control pressure, and a pump regulator (4) for changing the displacement volume of said hydraulic pump dependent upon said control pressure.

10. A hydraulic drive system for a construction machine according to claim 9, wherein said flow resistive means includes a fixed restrictor (16).

* * * * *